US008993865B2

(12) United States Patent
Liao

(10) Patent No.: US 8,993,865 B2
(45) Date of Patent: Mar. 31, 2015

(54) PEDAL BEATING APPARATUS FOR MUSICAL INSTRUMENTS

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 55 days.

(21) Appl. No.: 13/731,962

(22) Filed: Dec. 31, 2012

(65) Prior Publication Data

US 2014/0182445 A1 Jul. 3, 2014

(51) Int. Cl.
*G10D 13/02* (2006.01)
*G10D 13/00* (2006.01)

(52) U.S. Cl.
CPC ..... *G10D 13/006* (2013.01)
USPC ..... 84/422.1

(58) Field of Classification Search
USPC ..... 84/422.1
See application file for complete search history.

(56) References Cited

U.S. PATENT DOCUMENTS 4,198,894 A * 4/1980 Della-Porta et al. ..... 84/422.1
5,565,637 A * 10/1996 Shigenaga ..... 84/422.1
6,011,208 A * 1/2000 Hoshino ..... 84/422.1
6,259,012 B1 * 7/2001 Hoshino ..... 84/422.1
6,596,934 B2 * 7/2003 Hsieh ..... 84/422.1
7,381,877 B2 * 6/2008 Shigenaga ..... 84/422.1
7,812,237 B1 * 10/2010 Dunnett ..... 84/422.1

* cited by examiner

*Primary Examiner* — Christopher Uhlir
(74) *Attorney, Agent, or Firm* — Muncy, Geissler, Olds & Lowe, P.C.

(57) ABSTRACT

A pedal beating apparatus for musical instruments comprises a pedal beating holder, an elevation adjustment tray and a clamp beam. The elevation adjustment tray is movable against the pedal beating holder and has an elevation difference curved surface. The pedal beating holder has a fulcrum member. The clamp beam hinged on the fulcrum member has a clamp end and a leaning end at two ends. A compression spring is interposed between the clamp beam and pedal beating holder and located between the clamp end and fulcrum member to allow the leaning end to move downward to contact the elevation difference curved surface. By moving the elevation adjustment tray, position of the leaning end contacting the elevation difference curved surface is adjusted to further drive the clamp end to move. Thus distance between the clamp end and clamp boss can be changed to rapidly clamp drum hoops with varying thicknesses.

9 Claims, 6 Drawing Sheets

PEDAL BEATING APPARATUS FOR MUSICAL INSTRUMENTS

FIELD OF THE INVENTION

The present invention relates to a pedal beating apparatus for musical instruments and particularly to a pedal beating apparatus for drums with different drum hoops.

BACKGROUND OF THE INVENTION

A beater aims to beat a drum to generate sound that determines the rhythm of music, which plays an important role in a music band. The timbre generated by beating a drum via the beater mainly is determined by the characteristics of the drum. Different drums have different timbres. Performers can change the drums according to their preferences and musical requirements during performance.

Referring to FIG. 1, a conventional beater 1 generally is installed on a pedal beating holder 2 controlled by a drummer's foot to get desired rhythm. To present different movement characteristics, the drums with different specifications and weights could be used. In order to fasten the drum hoop (not shown in the drawing) of a drum to the pedal beating holder 2, the conventional pedal beating holder 2 generally has a clamp board 3 to tightly fasten the drum hoop by screwing.

However, such an approach of clamping the drum hoop is tedious and time-consuming. Users have to bend their backs for a long time to fasten or unfasten the screw that is troublesome and cannot fully meet requirements for usability and convenience.

SUMMARY OF THE INVENTION

The primary object of the present invention is to provide a pedal beating apparatus for musical instruments that can quickly clamp different types of drum hoops to meet requirements for usability and convenience.

To achieve the foregoing object, the pedal beating apparatus according to the invention comprises a pedal beating holder, an elevation adjustment tray and a clamp beam. The pedal beating holder has a fulcrum member. The elevation adjustment tray is movable against the pedal beating holder and has an elevation difference curved surface. The clamp beam is hinged on the fulcrum member and includes a clamp end and a leaning end at two ends thereof. A compression spring is interposed between the clamp beam and the pedal beating holder and located between the clamp end and the fulcrum member to allow the leaning end to move downwards to contact the elevation difference curved surface. The pedal beating holder further includes a clamp boss facing the clamp end. Through the structure set forth above, by moving the elevation adjustment tray, the position of the leaning end contacting the elevation difference curved surface can be adjusted to make the leaning end move upwards or downwards. Thus a seesaw structure is formed to drive the clamp end to move up and down. Hence the clamp end and clamp boss can be used to clamp drum hoops with varying thicknesses promptly, thereby meet requirements for usability and convenience.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
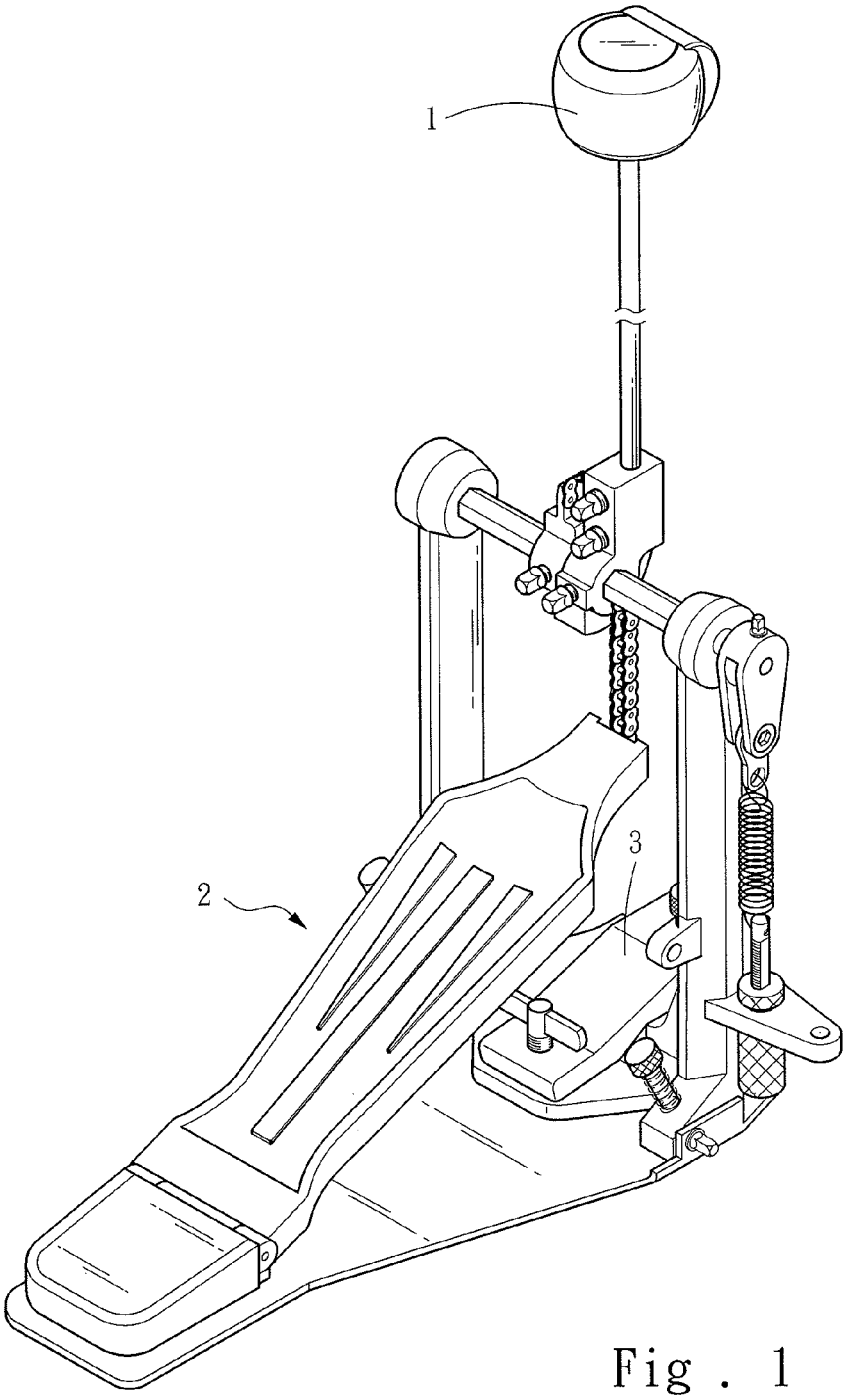
Fig. 1 PRIOR ART
FIG. 1 is a perspective view of a conventional structure.
Figure 2:
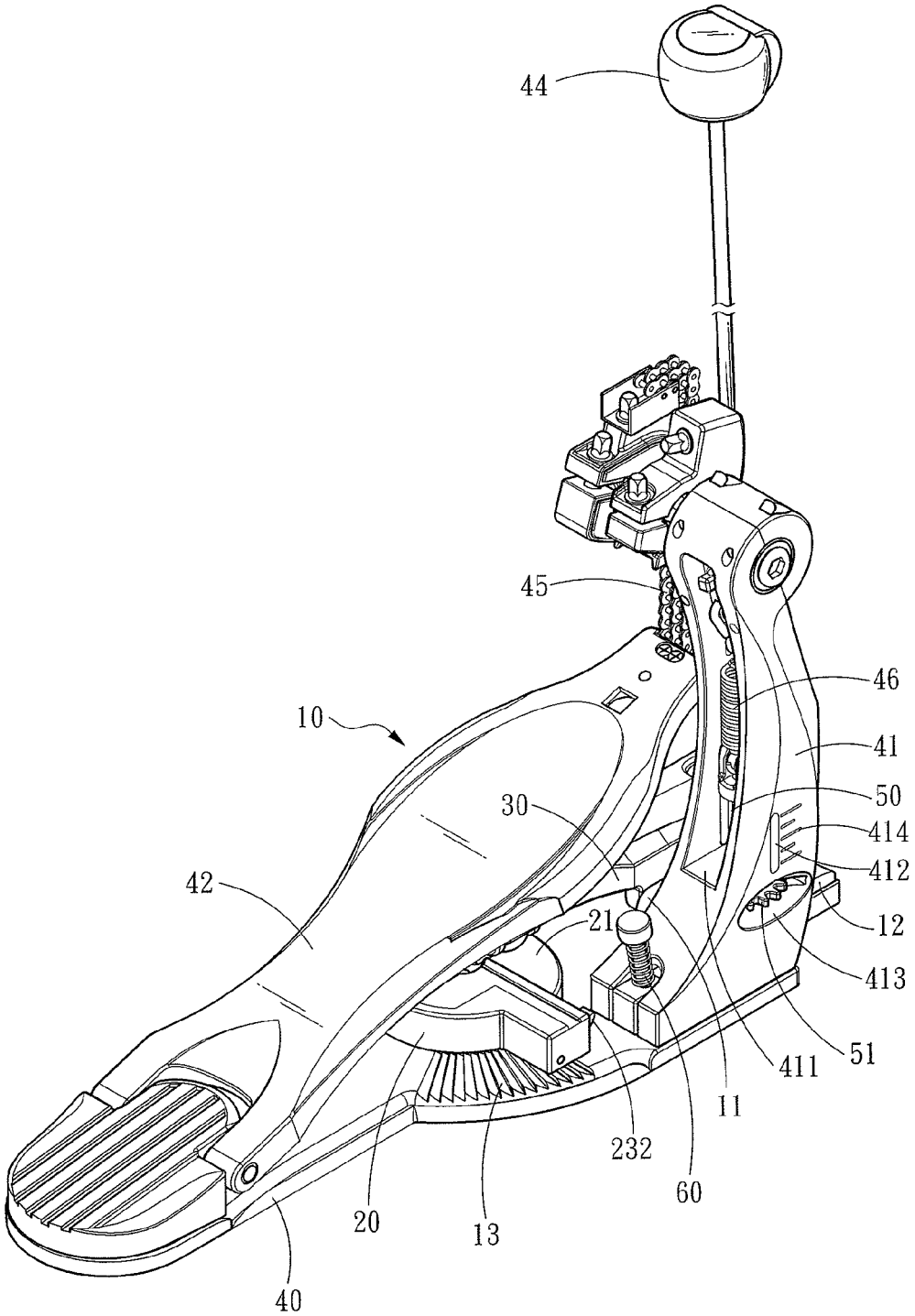
FIG. 2 is a perspective view of the invention.
Figure 3:
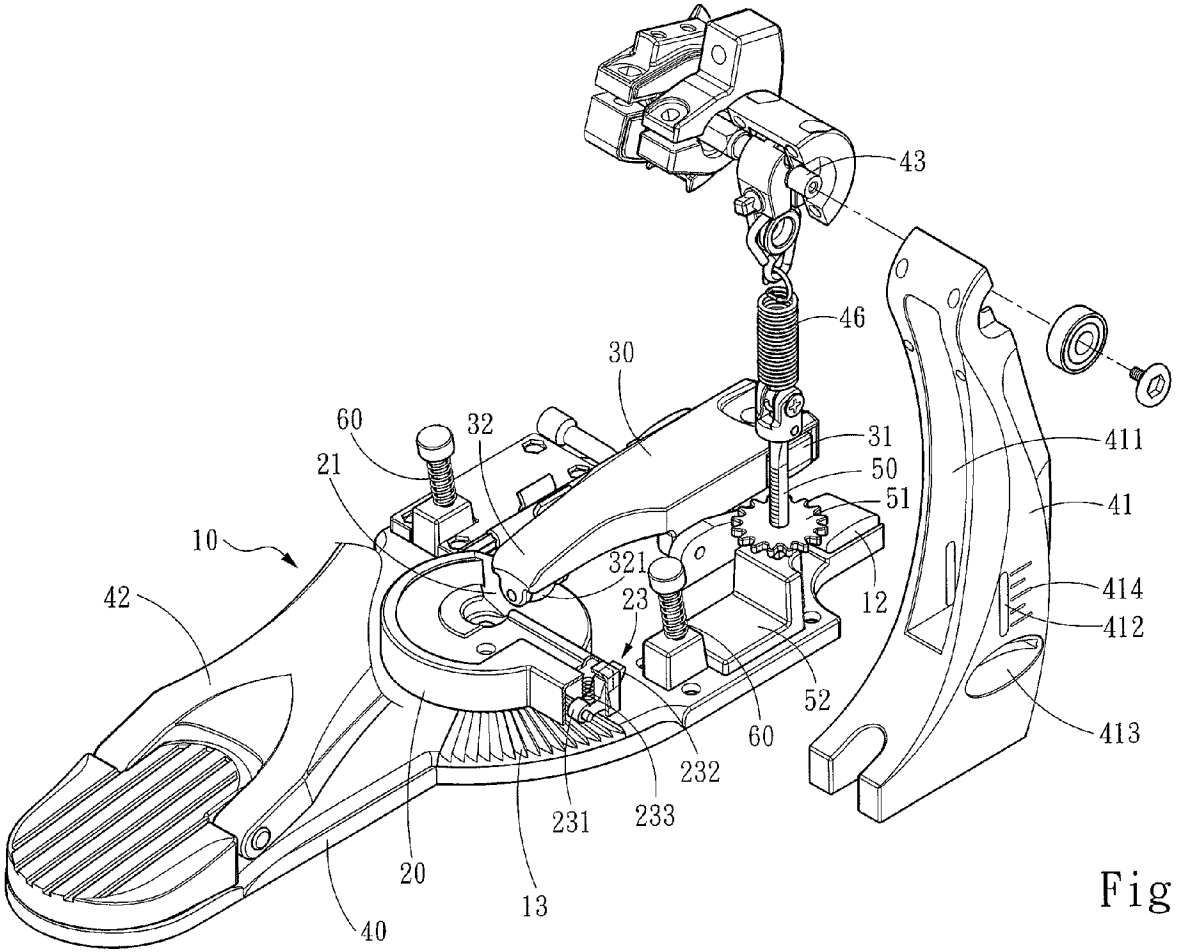
FIG. 3 is a fragmentary exploded view of the invention.
Figure 4:
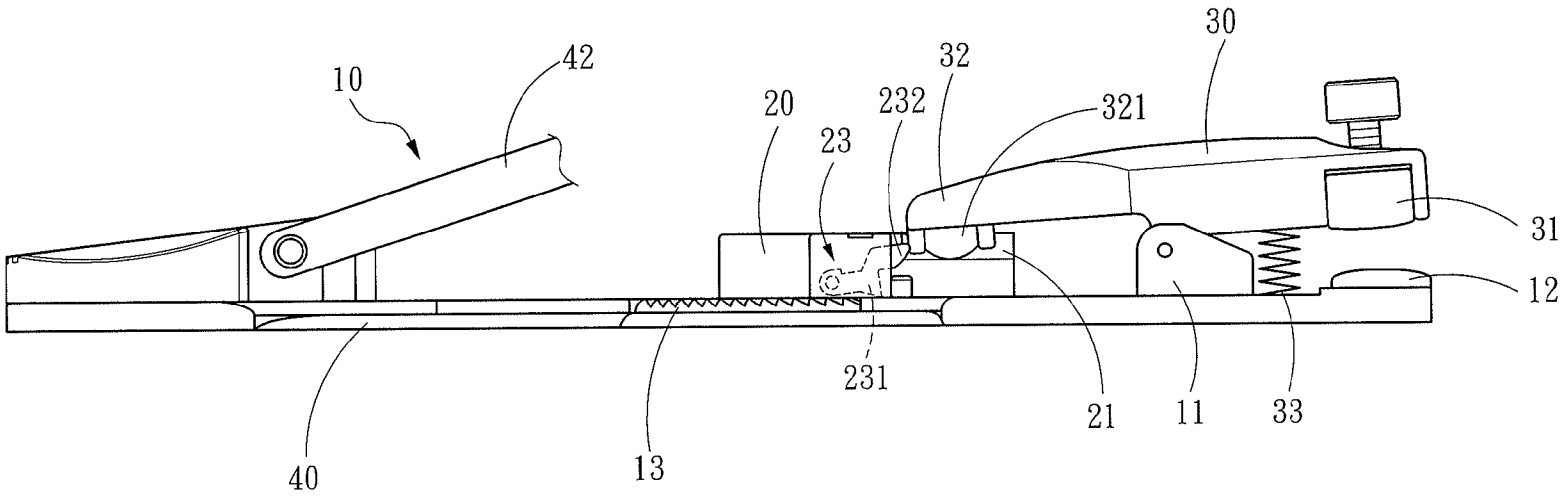
FIG. 4 is a fragmentary side view of the invention.

Please refer to FIGS. 2, 3 and 4, the present invention aims to provide a pedal beating apparatus for musical instruments. It comprises a pedal beating holder 10, an elevation adjustment tray 20 and a clamp beam 30. The pedal beating holder 10 has a fulcrum member 11. The elevation adjustment tray 20 is movable against the pedal beating holder 10 and includes an elevation difference curved surface 21. The clamp beam 30 is hinged on the fulcrum member 11 and includes a clamp end 31 and a leaning end 32 at two ends thereof. The leaning end 32 may have a leaning roller 321 located thereon. A compression spring 33 is interposed between the clamp beam 30 and the pedal beating holder 10 and located between the clamp end 31 and the fulcrum member 11 to allow the leaning end 32 to move downwards to contact the elevation difference curved surface 21. The pedal beating holder 10 further includes a clamp boss 12 facing the clamp end 31.

The elevation adjustment tray 20 is hinged on the pedal beating holder 10. The pedal beating holder 10 includes a plurality of check teeth 13. The elevation adjustment tray 20 includes a holding member 23 butting the check teeth 13 unidirectionally so that the elevation adjustment tray 20 is unidirectionally turnable against the pedal beating holder 10 to shrink gradually and irreversibly the distance between the clamp end 31 and clamp boss 12.

The holding member 23 is hinged on the elevation adjustment tray 20, and includes a butting portion 231 and a pulling portion 232. The butting portion 231 and the elevation adjustment tray 20 are interposed by a thrust spring 233 which pushes the butting portion 231 to butt the check teeth 13. The pulling portion 232 is pulled upwards to compress the thrust spring 233 to allow the butting portion 231 to separate from the check teeth 13.

The pedal beating holder 10 includes a base board 40, an upright pillar 41 fastened to the base board 40, a foot pedal 42 hinged on the base board 40, a rotary shaft 43 turnably hinged on the upright pillar 41, a beater 44 fastened to the rotary shaft 43, a drawing wire 45 connected to the foot pedal 42 and wound on the rotary shaft 43, and a return spring 46 bridging the rotary shaft 43 and the base board 40. The foot pedal 42 is movable against the base board 40 to draw the drawing wire 45 to drive the rotary shaft 43 to turn and drive the beater 44 to move.

The return spring 46 is connected to the base board 40 through a height adjustment rod 50 which runs through an adjustment ring 51 by screwing. The adjustment ring 51 is turnable against the base board 40 to change the elevation of the height adjustment rod 50 and alter the tension of the return spring 46. The adjustment ring 51 is fastened to the base board 40 through a pliable pad 52 which provides shock absorbing effect to enhance structural stability.

The upright pillar 41 includes a housing space 411 to hold the height adjustment rod 50, the return spring 46 and the adjustment ring 51 to provide protection thereof. The upright pillar 41 further includes an indication slot 412 for viewing the height adjustment rod 50, an adjustment opening 413 for exposing the adjustment ring 51, and a scale 414 adjacent to the indication slot 412 to indicate the elevation of the height adjustment rod 50 to facilitate changing of the elevation of the height adjustment rod 50 by turning the adjustment ring 51, thereby the tension of the return spring 46 can be adjusted to meet use requirements. Furthermore, the base board 40 includes at least one set screw 60 threading through the base board 40 to increase traction of the base board 40 and prevent the base board 40 from sliding.

Figure 5:
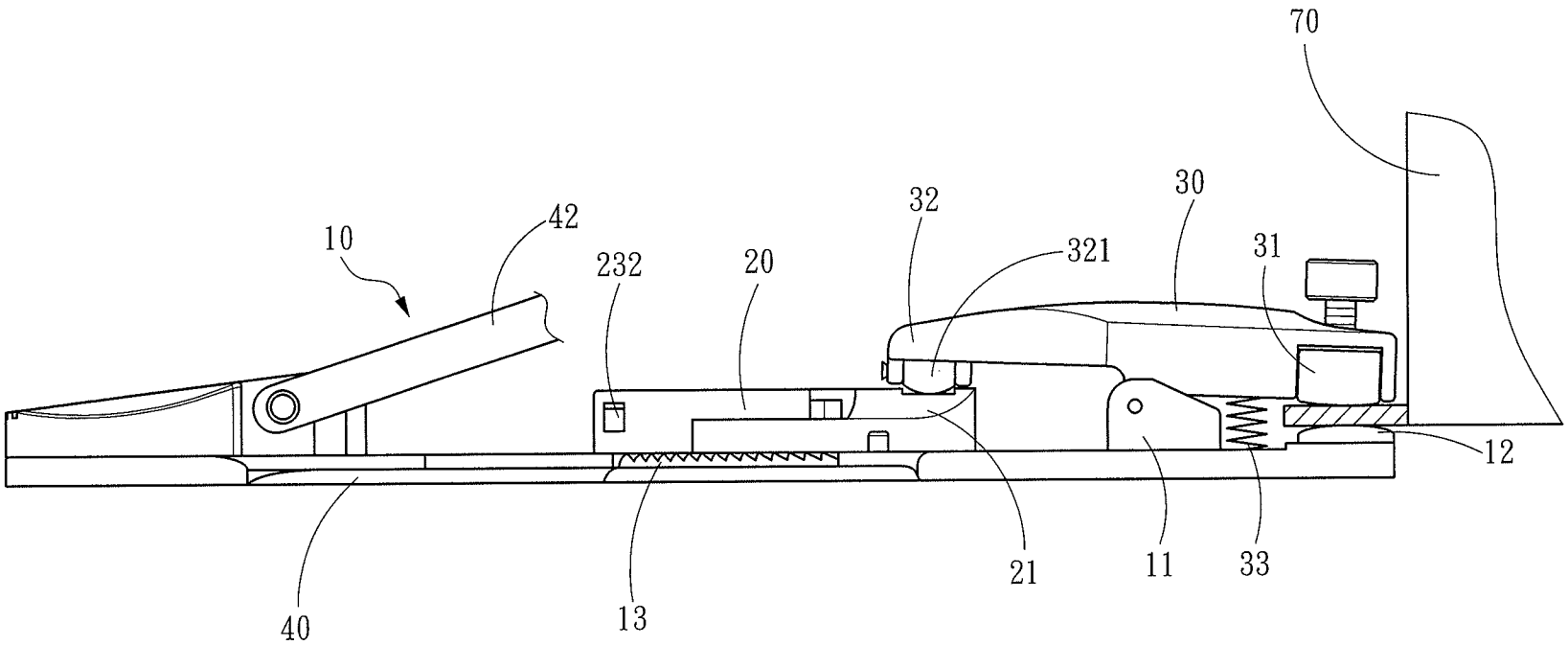
FIG. 5 is a schematic view of the invention clamping a drum hoop.
Figure 6:
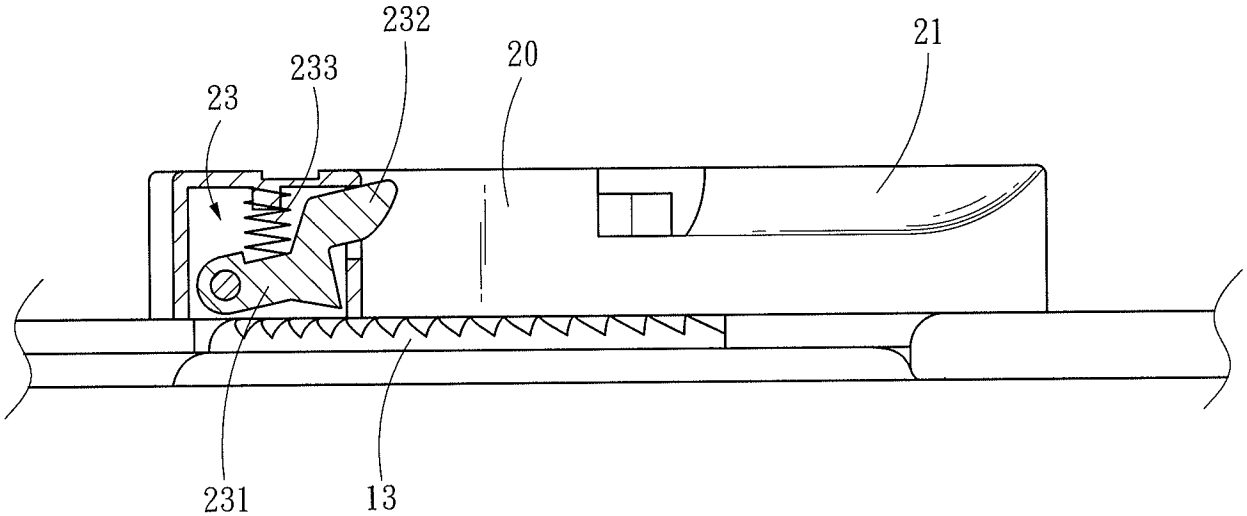
FIG. 6 is a schematic view of the invention with the pulling portion being pulled upwards.

Please refer to FIGS. 5 and 6, by turning the elevation adjustment tray 20, the distance between the clamp end 31 and clamp boss 12 can be shrunk gradually and irreversibly to clamp a drum hoop 70 (also referring to FIG. 5). When unfastening is required, the pulling portion 232 is pulled upwards to compress the thrust spring 233 (referring to FIG. 6) to allow the butting portion 231 to separate from the check teeth 13; meanwhile, the elevation adjustment tray 20 is turned reversely to increase the distance between the clamp end 31 and clamp boss 12, thus the drum hoop 70 can be loosened.

As a conclusion, by moving the elevation adjustment tray, the position of the leaning end contacting the elevation difference curved surface can be adjusted quickly to make the leaning end move upwards or downwards. Thus a seesaw structure is formed to drive the clamp end to move up and down. Hence the clamp end and clamp boss can be used to rapidly clamp drum hoops with varying thicknesses, thereby meet requirements for usability and convenience.

What is claimed is:

1. A pedal beating apparatus for musical instruments, comprising:

a pedal beating holder including a fulcrum member and a clamp boss;

a clamp beam which is hinged on the fulcrum member and includes a clamp end and a leaning end that are disposed at two ends thereof respectively, and a compression spring being interposed between the clamp end and the pedal beating holder, the clamp end facing the clamp boss, the compression spring pushing against the clamp beam and the pedal beating holder to separate the clamp end from the pedal beating holder; and an elevation adjustment tray which is hinged on the pedal beating holder for the leaning end of the clamp beam to lean on and includes an elevation difference curved surface contacting and supporting the leaning end, the elevation difference curved surface pushing the leaning end to drive the clamp end to move to change a distance between the clamp end and the clamp boss when the elevation adjustment tray rotates, wherein the elevation adjustment tray is hinged on the pedal beating holder, the pedal beating holder including a plurality of check teeth, the elevation adjustment tray including a holding member butting the plurality of check teeth unidirectionally so that the elevation adjustment tray is unidirectionally turnable against the pedal beating holder to shrink gradually and irreversibly the distance between the clamp end and the clamp boss to clamp a drum hoop.

2. The pedal beating apparatus of claim 1, wherein the holding member is hinged on the elevation adjustment tray and includes a butting portion and a pulling portion, the butting portion and the elevation adjustment tray being interposed by a thrust spring which pushes the butting portion to butt the plurality of check teeth, the pulling portion being pulled upwards to compress the thrust spring to allow the butting portion to separate from the plurality of check teeth.

3. The pedal beating apparatus of claim 1, wherein the leaning end includes a leaning roller.

4. The pedal beating apparatus of claim 1, wherein the pedal beating holder includes a base board, an upright pillar fastened to the base board, a foot pedal hinged on the base board, a rotary shaft turnably hinged on the upright pillar, a beater fastened to the rotary shaft, a drawing wire connected to the foot pedal and wound on the rotary shaft and a return spring bridging the rotary shaft and the base board, the foot pedal being movable against the base board to draw the drawing wire to drive the rotary shaft to turn and drive the beater to move.

5. The pedal beating apparatus of claim 4, wherein the return spring is connected to the base board through a height adjustment rod which runs through an adjustment ring by screwing, the adjustment ring being turnable against the base board to change an elevation of the height adjustment rod and alter the tension of the return spring.

6. The pedal beating apparatus of claim 5, wherein the adjustment ring is fastened to the base board through a pliable pad.

7. The pedal beating apparatus of claim 5, wherein the upright pillar includes a housing space to hold the height adjustment rod, the return spring and the adjustment ring.

8. The pedal beating apparatus of claim 7, wherein the upright pillar includes an indication slot for viewing the height adjustment rod, an adjustment opening for exposing the adjustment ring and a scale adjacent to the indication slot.

9. The pedal beating apparatus of claim 5, wherein the base board includes at least one set screw threading through the base board.

* * * * *